US012780270B2

(12) United States Patent
Drexler et al.

(10) Patent No.: US 12,780,270 B2
(45) Date of Patent: Nov. 3, 2026

(54) RAIL VEHICLE HAVING CENTRAL BUFFER COUPLING

(71) Applicant: Siemens Mobility GmbH, Munich (DE)

(72) Inventors: Stephan Drexler, Sauerlach (DE); Ignacio Garcia Francisco, Munich (DE); Marcus Körner, Grossinzemoos (DE); Jörg Melde, Olching (DE); Hannes Peer, Munich (DE)

(73) Assignee: Siemens Mobility GmbH, Munich (DE)

( * ) Notice: Subject to any disclaimer, the term of this patent is extended or adjusted under 35 U.S.C. 154(b) by 480 days.

(21) Appl. No.: 18/554,665

(22) PCT Filed: Mar. 3, 2022

(86) PCT No.: PCT/EP2022/055372
§ 371 (c)(1),
(2) Date: Oct. 10, 2023

(87) PCT Pub. No.: WO2022/214246
PCT Pub. Date: Oct. 13, 2022

(65) Prior Publication Data

US 2024/0199094 A1 Jun. 20, 2024

(30) Foreign Application Priority Data

Apr. 7, 2021 (DE) ..... 10 2021 203 426.8

(51) Int. Cl.
*B61G 7/10* (2006.01)
*B61G 11/16* (2006.01)

(52) U.S. Cl.
CPC ..... *B61G 7/10* (2013.01); *B61G 11/16* (2013.01)

(58) Field of Classification Search
CPC ... B61G 7/00; B61G 7/10; B61G 7/14; B61G 9/00; B61G 9/20; B61G 9/22;
(Continued)

(56) References Cited

U.S. PATENT DOCUMENTS 921,564 A * 5/1909 Rosengren ..... B61G 7/10 213/112
8,783,479 B2 7/2014 Ewerding
(Continued)

FOREIGN PATENT DOCUMENTS

CN 103625502 B 5/2016
CN 205396117 U 7/2016
(Continued)

OTHER PUBLICATIONS

Norm EN 15227:2020, "Railway applications—Crashworthless requirements for railway vehicle bodies", EN 15227:2008+A1:2010, Nov. 2010, ICS 45.060.01—English version.

*Primary Examiner* — S. Joseph Morano
*Assistant Examiner* — Heaven R Buffington
(74) *Attorney, Agent, or Firm* — Laurence A. Greenberg; Werner H. Stemer; Ralph E. Locher

(57) ABSTRACT

A rail vehicle has a central buffer coupling with a coupling head, a rod-shaped coupling shaft and a spring mechanism. The coupling head connects to a coupling head of another rail vehicle and is connected to the coupling shaft. The shaft is inserted into the spring mechanism and is mounted and fastened therein such that, during operation of the rail vehicle, impact forces or tensile forces acting on the coupling head are resiliently absorbed by the spring mechanism and transferred to a wagon body. A support is coupled to the coupling shaft and is connected to the wagon body. A collision element is arranged between the support and the wagon body. The collision element has a deformation region configured such that kinetic energy, transferred to the col-
(Continued)

lision element via the coupling shaft and via the coupled support due to a collision, irreversibly deforms the deformation region in a predetermined manner.

9 Claims, 8 Drawing Sheets

(58) Field of Classification Search
CPC ..... B61G 11/00; B61G 11/16; B61F 19/04; F16F 7/003; F16F 7/12
USPC ..... 213/5, 7, 40 R, 50, 58, 59, 60, 61, 62 R, 213/75 R, 220, 221
See application file for complete search history.

(56) References Cited

U.S. PATENT DOCUMENTS

| | | | | |
|---|---|---|---|---|
| 10,589,761 | B2 | 3/2020 | Kroiss et al. | |
| 2008/0277366 | A1* | 11/2008 | Kemper | B61G 7/08 213/75 R |

FOREIGN PATENT DOCUMENTS

| | | | |
|---|---|---|---|
| CN | 111452822 | A | 7/2020 |
| CN | 112124353 | A | 12/2020 |
| DE | 20009859 | U1 | 10/2001 |
| DE | 202004014532 | U1 | 2/2006 |
| EP | 2594452 | A1 | 5/2013 |
| EP | 2617622 | A1 | 7/2013 |
| JP | S49138507 | U | 11/1974 |
| WO | 2016146170 | A1 | 9/2016 |
| WO | 2020178223 | A1 | 9/2020 |

* cited by examiner

RAIL VEHICLE HAVING CENTRAL BUFFER COUPLING

FIELD AND BACKGROUND OF THE INVENTION

The invention relates to a rail vehicle comprising a central buffer coupling.

It is known to connect rail vehicles to one another by way of what are known as central buffer couplings. Central buffer couplings are used in passenger transport and inp freight transport and during operation absorb both tensile forces and impact or thrust forces from interconnected rail vehicles.

FIG. 5 and FIG. 6 show two views of a central buffer coupling MPK according to the known prior art.

The central buffer coupling MPK comprises, as elements, a coupling head KPK, a bar-like coupling shaft KPS, a coupling pin KPB and a spring mechanism FDW.

The coupling head KPK of a rail vehicle is configured for connection to a coupling head of a further rail vehicle (not illustrated here).

The coupling head KPK is connected to a first side of a bar-like coupling shaft KPS. The second side of said coupling shaft, which lies opposite the first side of the coupling shaft KPS, dips into the spring mechanism FDW in a movably mounted manner and is guided by it.

The spring mechanism FDW is connected at one end END to a carriage body (not illustrated here) of the rail vehicle and contains a resilient or elastic fastening of the second end of the coupling shaft KPS in the interior of the spring mechanism FDW.

The spring mechanism FDW is designed in such a way that tensile forces or compressive forces which act via the coupling head KPK and the coupling shaft KPS between the coupled rail vehicles are absorbed and possibly transmitted to the carriage body in a damped manner.

In addition, the spring mechanism FDW for example comprises energy dissipation elements, with the aid of which kinetic energy acting via the coupling shaft KPS on the spring mechanism FDW is dissipated or converted in the event of a collision. The energy dissipation elements are permanently plastically deformed in the process.

The central buffer coupling MPK is mounted so as to be rotatable about a vertical axis by way of the coupling pin KPB. This ensures a transmission of force between the coupled rail vehicles during cornering.

The central buffer coupling MPK, more precisely the coupling shaft KPS thereof, is downwardly supported in a resilient manner in the vertical direction via a pendulum support PAS. The pendulum support PAS ensures that, in the operative and non-coupled mode of the rail vehicle, the central buffer coupling MPK assumes a target position in a horizontal direction.

The pendulum support PAS is primarily used to bear the dead weight of the central buffer coupling MPK in the uncoupled state.

The pendulum support PAS also permits a horizontal movement of the coupling shaft KPS within predefined limits. The pendulum support PAS is connected for example via carriers (not illustrated here) to the carriage body of the rail vehicle.

Other configurations for the vertical support of the central buffer coupling are known. By way of example, in the case of what is known as a "beam support", the coupling shaft of the central buffer coupling rests on a transverse beam. The transverse beam is configured to support the coupling shaft in a resilient manner in the vertical direction and is connected for example via carriers to the carriage body of the rail vehicle.

Alternative configurations are also known for the spring mechanism. By way of example, the spring mechanism is arranged so as to be integrated into the coupling shaft.

FIG. 7 shows a central buffer coupling MPK7 on a rail vehicle SFZ7 together with a support ABS7 according to the prior art.

FIG. 8 shows a central buffer coupling MPK8 on a rail vehicle SFZ8 together with a support ABS8 according to the prior art.

The central buffer coupling MPK8 shown here comprises, on its coupling head or in the surroundings thereof, a coupling hook as additional coupling element of a screw coupling. Such a central buffer coupling MPK8 is referred to as "mixed train coupling" because it enables two types of coupling.

Firstly, a coupling to a rail vehicle via the central buffer coupling described in figures FIG. 5 and FIG. 6 is enabled. Secondly, a coupling to a rail vehicle having a screw coupling is enabled, the coupling hook on the coupling head forming part of the screw coupling.

Since the screw coupling is configured to exclusively transmit tensile forces, two side buffers for transmitting compressive forces are additionally provided on the rail vehicle.

For central buffer couplings, a new standard (standard EN 15227:2020, "Railway applications—Crashworthiness requirements for rail vehicle bodies") places increased requirements on the crashworthiness of locomotives or rail vehicles. In comparison with earlier embodiments, the central buffer coupling must be configured to absorb an increased impact energy or kinetic energy in order to be classified as "crashworthy".

SUMMARY OF THE INVENTION

It is the object of the present invention to specify a rail vehicle comprising a central buffer coupling with which increased crashworthiness is obtained.

This object is achieved by means of the features of the independent patent claim. Advantageous developments are specified in the subclaims.

The invention relates to a rail vehicle comprising a central buffer coupling.

The central buffer coupling comprises, as elements, a coupling head, a bar-like coupling shaft and a spring mechanism. The coupling head is configured for connection to a coupling head of a further rail vehicle. The coupling head is connected to a first side of the coupling shaft. A second side of the coupling shaft dips into the spring mechanism and is mounted and fastened therein in such a way that, in the operative mode of the rail vehicle, impact forces or tensile forces acting on the coupling head are elastically absorbed by the spring mechanism, which is connected to a carriage body of the rail vehicle, and are transmitted to the carriage body.

A support is coupled to the coupling shaft and connected to the carriage body. Said support is configured to vertically support the coupling shaft in order to downwardly support it in a resilient manner in the vertical direction. In addition, said support is configured to bear the dead weight of the elements of the central buffer coupling in order to implement or to ensure a horizontal orientation of the central buffer coupling in the operative mode of the rail vehicle.

According to the invention, a collision element is arranged between the support and the carriage body and is connected both to the support and to the carriage body—this is preferably a firm but releasable connection in each case.

The collision element has, with the functionality of what is known as a "crash box", a deformation region which is non-reversibly deformed in a predefined manner by kinetic energy which is transmitted via the central buffer coupling and via the coupled support to the collision element in the event of a collision.

In the event of a collision between the rail vehicle and another rail vehicle, the deformation region provides an additional distance along which the deformation of the deformation region is effected.

As a result, the conversion of the kinetic energy into deformation energy is assisted in the event of a collision.

In an advantageous development, the collision element comprises a first flange by way of which the collision element is firmly but releasably connected to a front plate of the carriage body by a screw connection.

The collision element comprises a second flange which lies opposite the first flange, the second flange being firmly but releasably connected to the support by a screw connection.

The deformation region is arranged between the first flange and the second flange. The mentioned screw connections are configured in such a way that an exchange of the collision element is possible after a collision.

In an advantageous development, the collision element at least partially surrounds the coupling shaft so as to enable a horizontal movement of the coupling shaft (KPS) to a predetermined extent.

In an advantageous development, the support at least partially surrounds the coupling shaft so as to enable a horizontal movement of the coupling shaft to a predetermined extent.

The support is coupled to the coupling shaft. In an advantageous development, this coupling is implemented by the at least partial surrounding of the coupling shaft by the support. In the event of a collision, the coupling shaft executes a longitudinal movement in the direction of the rail vehicle or in the direction of the carriage body of the rail vehicle. As a result, the coupling head is pushed against the support in the event of a collision. The associated kinetic energy from the collision is transmitted via the support to the collision element, in order to there trigger the deformation of the deformation region.

In an advantageous development, the spring mechanism comprises energy dissipation elements which are configured in such a way that kinetic energy, which is transmitted via the coupling shaft to the spring mechanism in the event of a collision, irreversibly plastically deforms the energy dissipation elements for energy compensation purposes.

In an advantageous development, the central buffer coupling is part of a mixed train coupling.

In an advantageous development, the support is in the form of a pendulum support or in the form of a beam support, which are in each case at least partially arranged under the coupling shaft.

Advantages

The present invention enables cost-effective retrofitting of rail vehicles which are already in operation in order to increase the crashworthiness.

In the event of damage, the present invention enables a simple exchange of damaged components, in particular of the collision element, and thus a simple and rapid repair.

The present invention enables a standardized energy dissipation, which is effected by way of non-reversible energy dissipation elements.

The present invention can be used or retrofitted in standardized but different central buffer couplings, the construction of which is structurally identical with the exception of the coupling heads.

The present invention can also be used in what are known as "mixed train couplings", in which geometrical dependencies of the central buffer coupling in relation to the associated side buffers have to be observed.

The present invention avoids a conceivable alternative extension of the coupling shaft, which would be implementable only with extreme difficulty on account of the resultant increased lever forces and torques on the components of the central buffer coupling.

BRIEF DESCRIPTION OF THE FIGURES

The invention will be explained in more detail below on the basis of a drawing, in which.

DETAILED DESCRIPTION OF THE INVENTION

Figure 1:
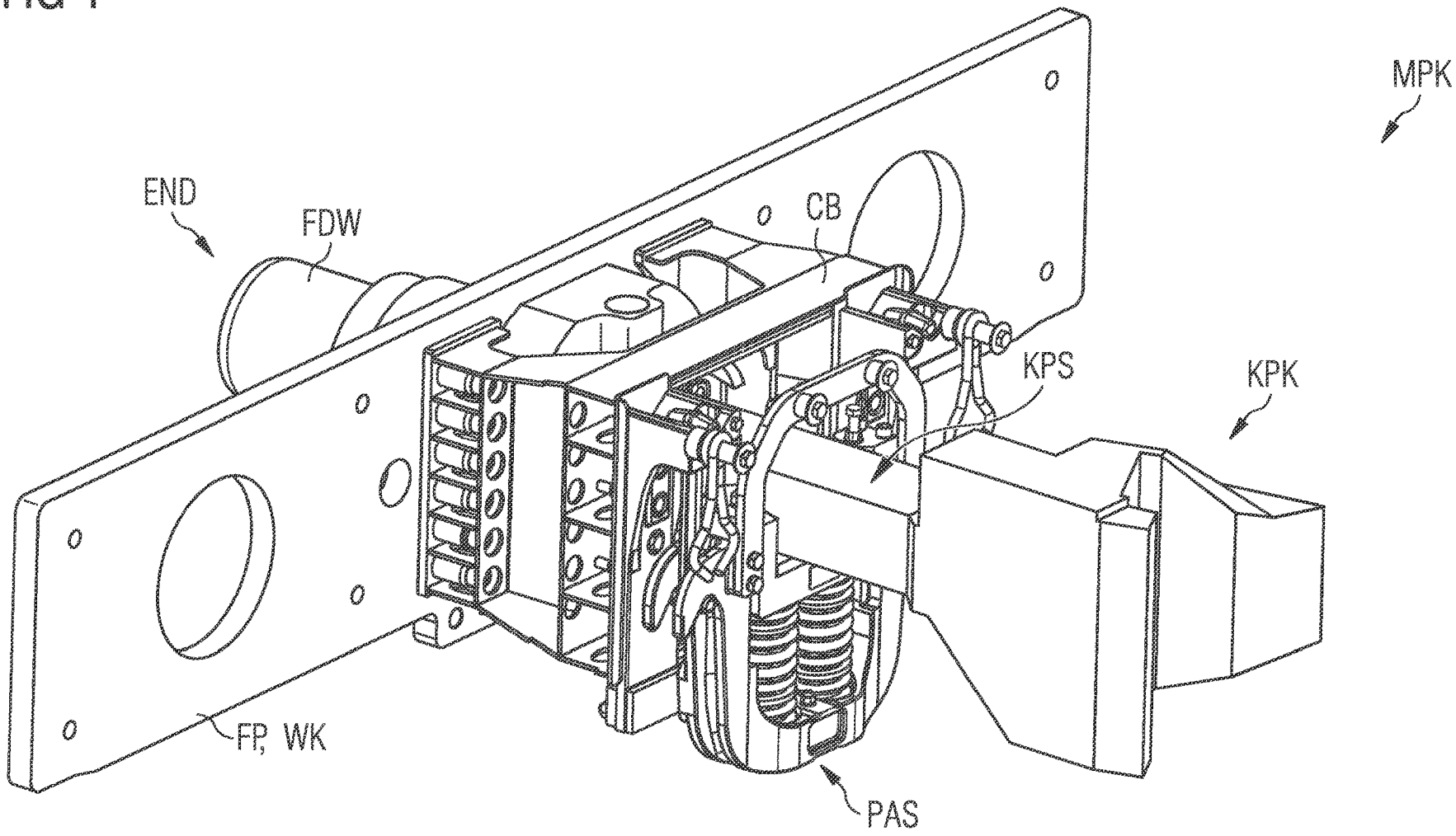
FIG. 1 shows a first example of the invention on the basis of a central buffer coupling with a pendulum support.

FIG. 1 shows a first example of the invention on the basis of a central buffer coupling MPK with a pendulum support.

The central buffer coupling MPK comprises, as elements, a coupling head KPK, a bar-like coupling shaft KPS, a coupling pin KPB and a spring mechanism FDW.

The coupling head KPK is configured for connection to a coupling head of a further rail vehicle.

The coupling head KPK is connected to a first side of a bar-like coupling shaft KPS. The second side of said coupling shaft, which lies opposite the first side of the coupling shaft KPS, dips into the spring mechanism FDW in a movably mounted manner and is guided by it.

The spring mechanism FDW is connected at one end END to a carriage body WK of the rail vehicle and contains a resilient or elastic fastening of the second end of the coupling shaft KPS in the interior of the spring mechanism FDW.

The spring mechanism FDW is designed in such a way that tensile forces or compressive forces which act via the coupling head KPK and the coupling shaft KPS between the coupled rail vehicles are absorbed and possibly transmitted to the carriage body WK in a damped manner.

The central buffer coupling MPK is mounted so as to be rotatable about a vertical axis by way of a coupling pin (not illustrated here). This ensures a transmission of force between the coupled rail vehicles during cornering.

The central buffer coupling MPK, more precisely the coupling shaft KPS thereof, is downwardly supported in a resilient manner in the vertical direction via a support PAS, which is in the form of a pendulum support by way of example here.

The pendulum support PAS ensures that, in the operative and non-coupled mode of the rail vehicle, the central buffer coupling MPK assumes a predetermined target position in a horizontal direction on the rail vehicle.

The pendulum support PAS also permits a horizontal movement of the coupling shaft KPS within predefined limits.

According to the invention, the pendulum support PAS is connected via a collision element CB, referred to as "crash box", to a front plate FP of the carriage body WK of the rail vehicle.

In this case, the collision element CB also surrounds the coupling shaft KPS, correspondingly to the pendulum support PAS, such that the vertical or horizontal movement of the coupling shaft KPS can be effected to a predetermined extent.

Here, the central buffer coupling MKP is in a normal position, i.e. the coupling head KPK is at a predetermined distance from the pendulum support PAS in relation to the direction of travel of the rail vehicle.

Figure 2:
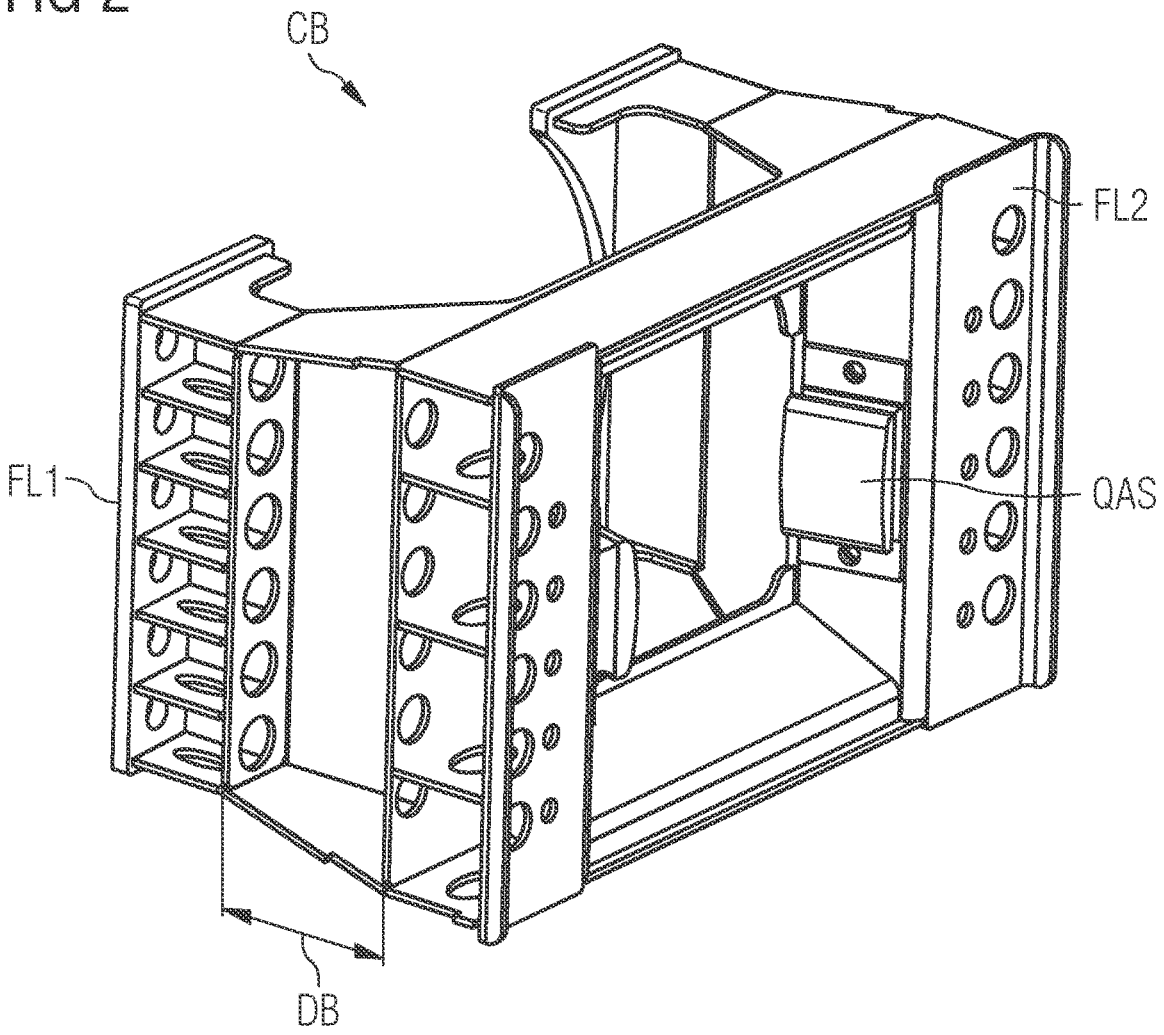
FIG. 2 shows, with reference to FIG. 1, details of the associated collision element, referred to as "crash box"

FIG. 2 shows, with reference to FIG. 1, details of the associated collision element CB.

The collision element CB comprises a first flange FL1 by way of which the collision element CB is connected to the front plate FP and thus to the carriage body WK of the rail vehicle.

The collision element CB comprises a second flange FL2 which lies opposite the first flange FL1. The collision element CB is connected to the pendulum support PAS by way of the second flange FL2.

The collision element CB also comprises transverse stops QAS, which are arranged and designed in such a way that the horizontal movement of the coupling shaft KPS is limited, preferably is limited in a cushioned manner.

The collision element CB has a deformation region DB configured for a collision.

Figure 3:
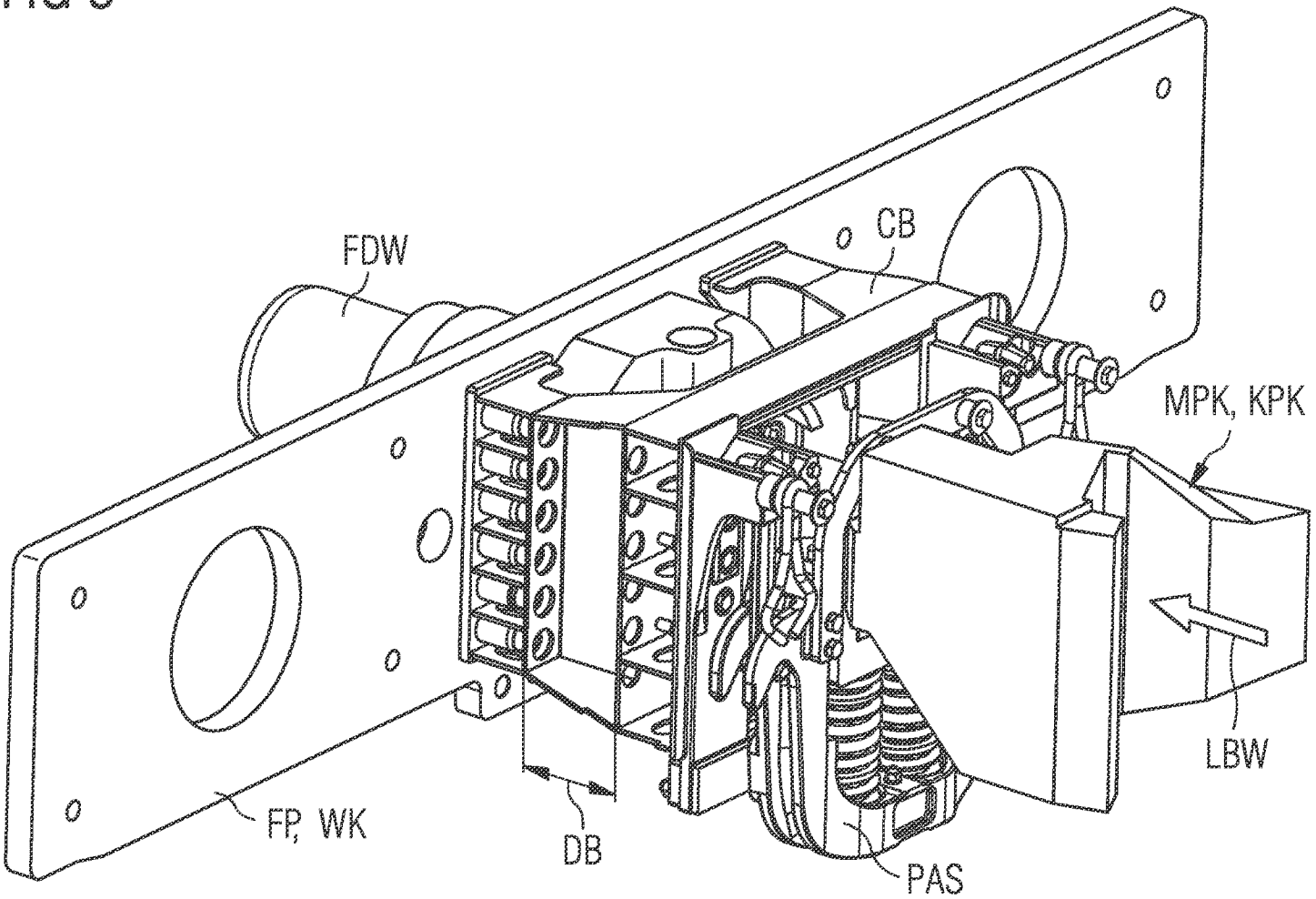
FIG. 3 shows, with reference to FIG. 1 and FIG. 2, elements of the invention in a further detail illustration.

Kinetic energy which acts on the collision element CB in the event of a collision, which is shown in FIG. 3, brings about a permanent and predetermined deformation of the deformation region DB along a collision direction—the deformation region DB is thus crushed inward in the event of a collision.

In the event of a collision, the deformation region DB provides an additional distance along which the deformation of the deformation region DB is effected. As a result, the conversion of the kinetic energy into deformation energy is assisted in the event of a collision.

FIG. 3 shows, with reference to FIG. 1 and FIG. 2, elements of the invention in a further detail illustration.

Whereas FIG. 1 shows the central buffer coupling MPK in the normal position, in which the coupling head KPK is at a predetermined distance from the pendulum support PAS, FIG. 3 shows the position of the central buffer coupling MPK in the event of a collision, wherein here the collision takes place by way of example parallel to the direction of travel of the rail vehicle and thus substantially parallel to the horizontal orientation of the central buffer coupling MPK.

During the collision, the collision energy acts as kinetic energy on the coupling head KPK of the central buffer coupling MPK.

As a result, the central buffer coupling MPK is subjected to a longitudinal movement LBW in the direction of the carriage body WK of the rail vehicle.

The coupling head KPK is pushed or knocked against the pendulum support PAS by this longitudinal movement LBW. The associated kinetic energy is transmitted to the collision element CB which is fastened to the carriage body WK or to the front plate FP thereof.

The deformation region DB is compressed as a result, in order to provide the additional distance described in FIG. 2.

The kinetic energy is additionally transmitted via the coupling shaft KPS of the central buffer coupling MPK to the spring mechanism FDW.

Arranged in this spring mechanism FDW are energy dissipation elements which are permanently plastically deformed by the kinetic energy. As a result, the kinetic energy is dissipated or absorbed in connection with the carriage body WK to which the spring mechanism is fastened.

Figure 4:
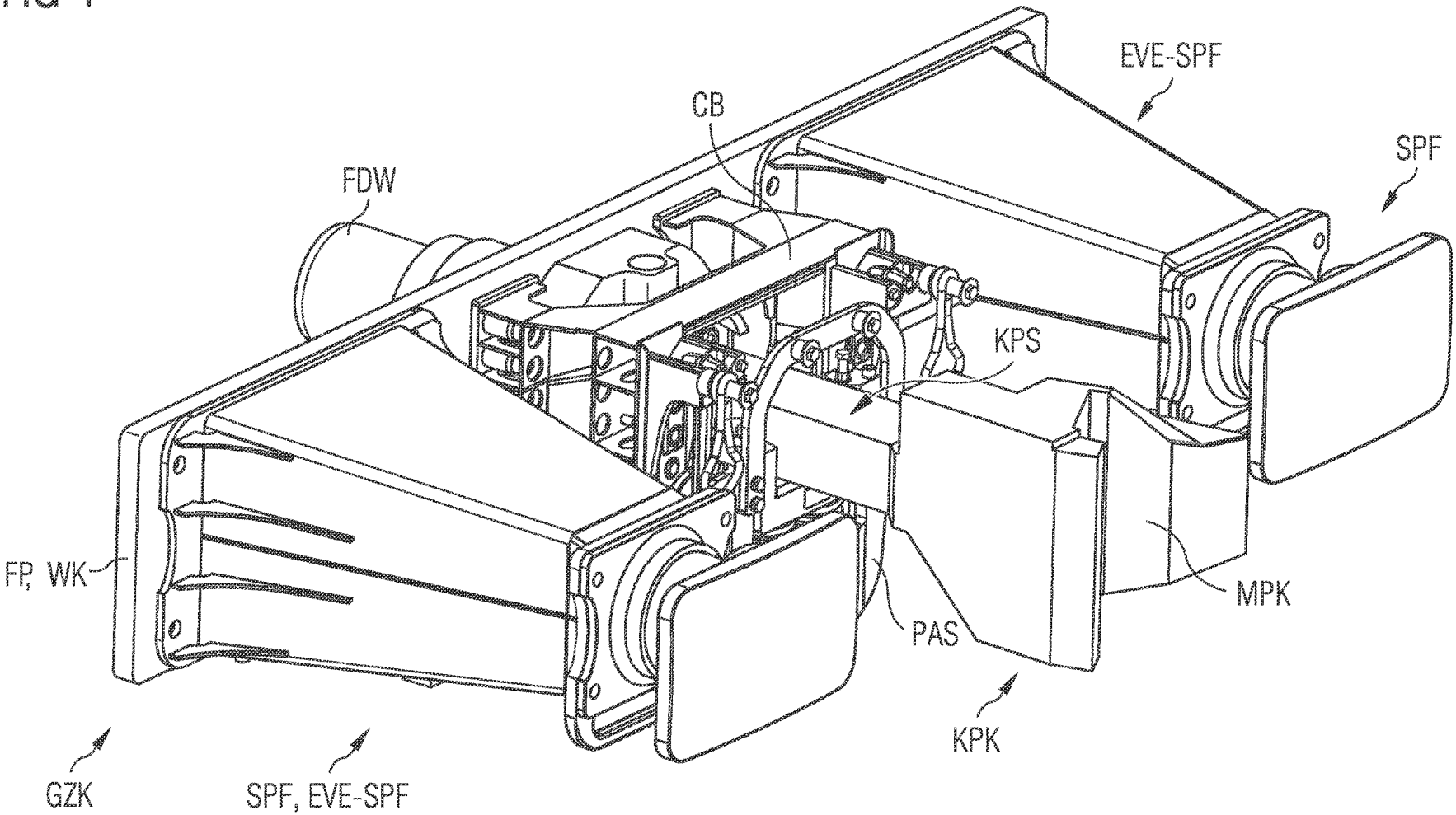
FIG. 4 shows a second example of the invention on the basis of a mixed train coupling.
Figure 5:
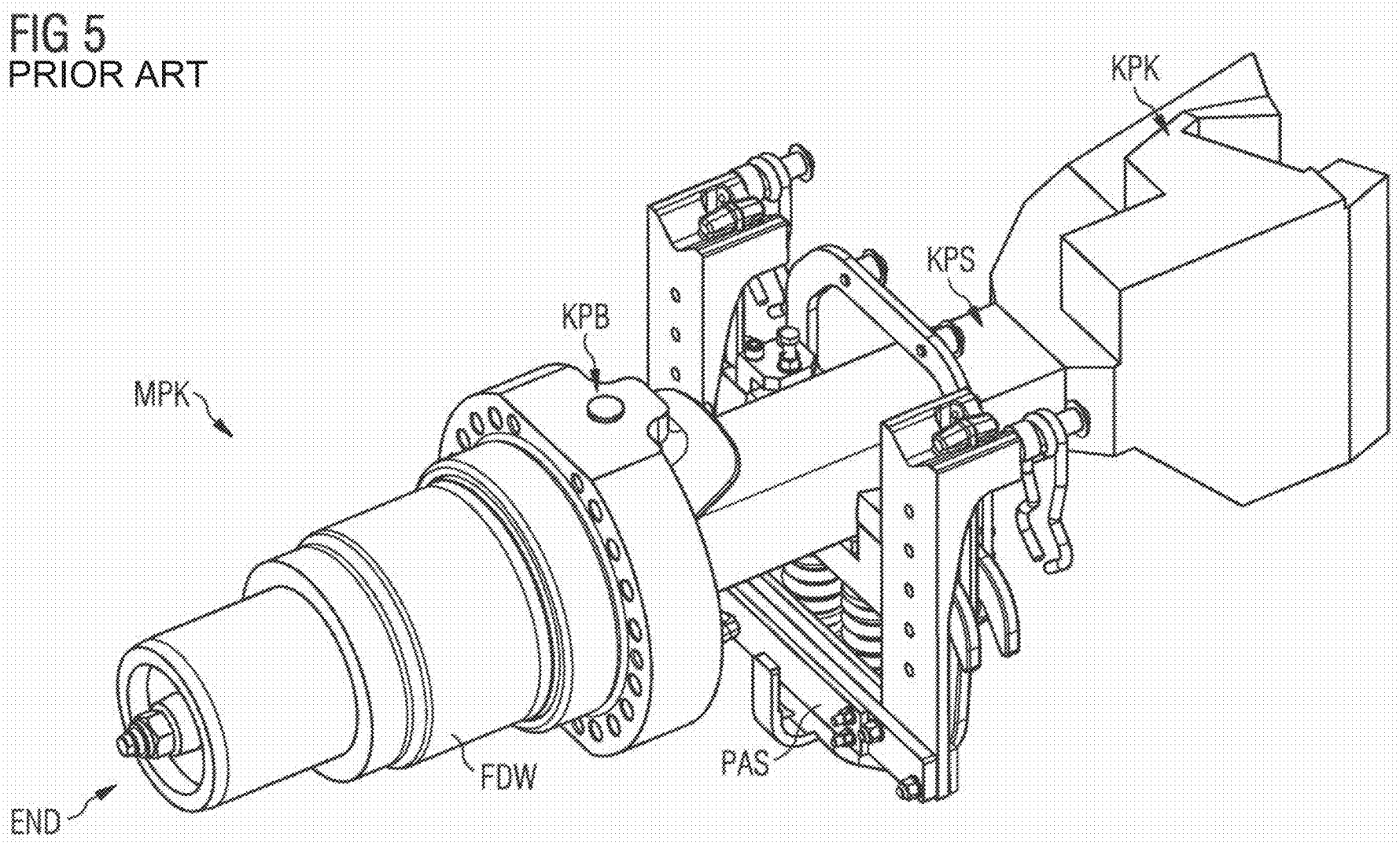
FIG 5 PRIOR ART
FIG. 5 to FIG. 8 show the prior art described in the introduction.
Figure 6:
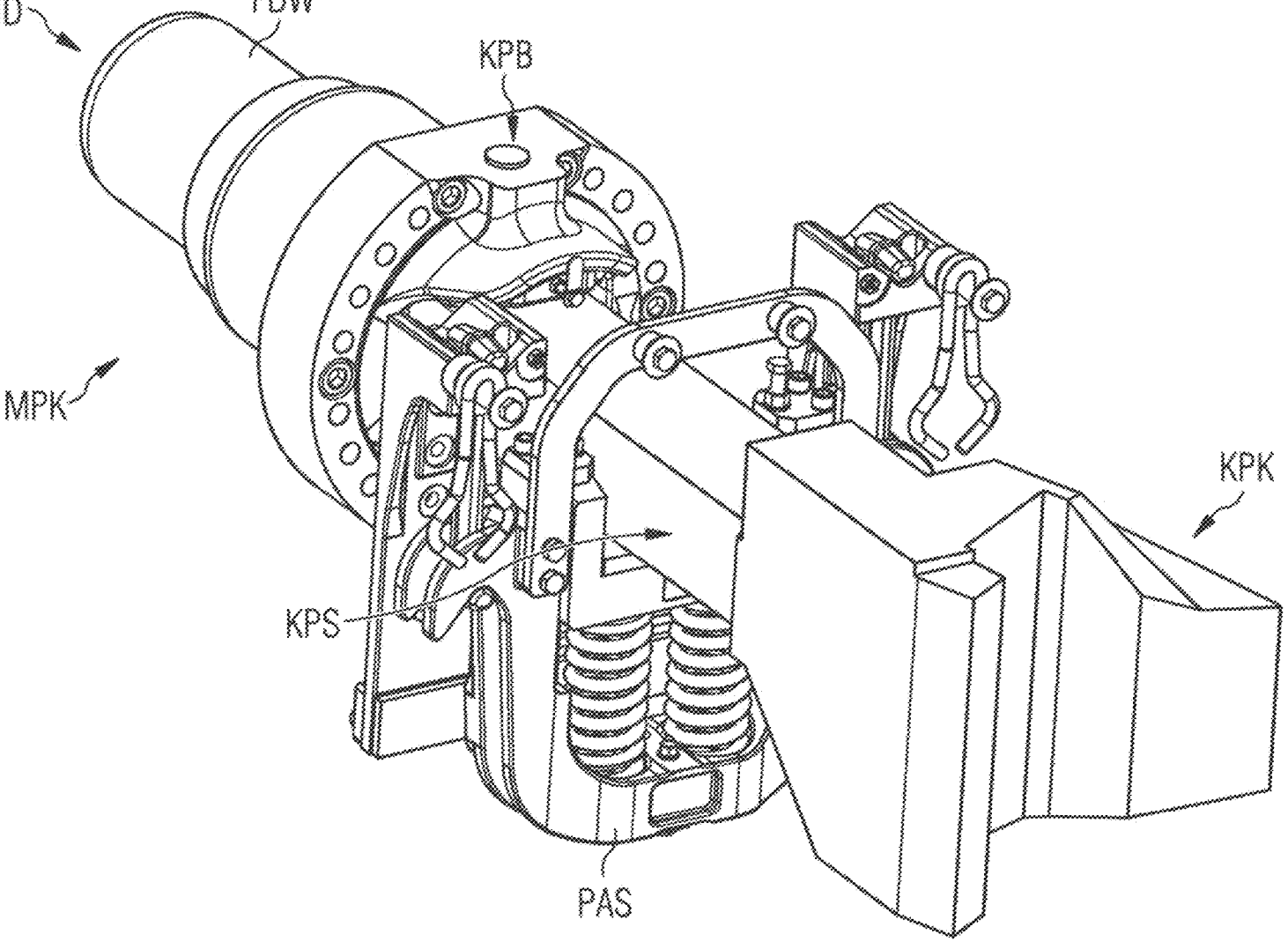
FIG 6 PRIOR ART
Figure 7:
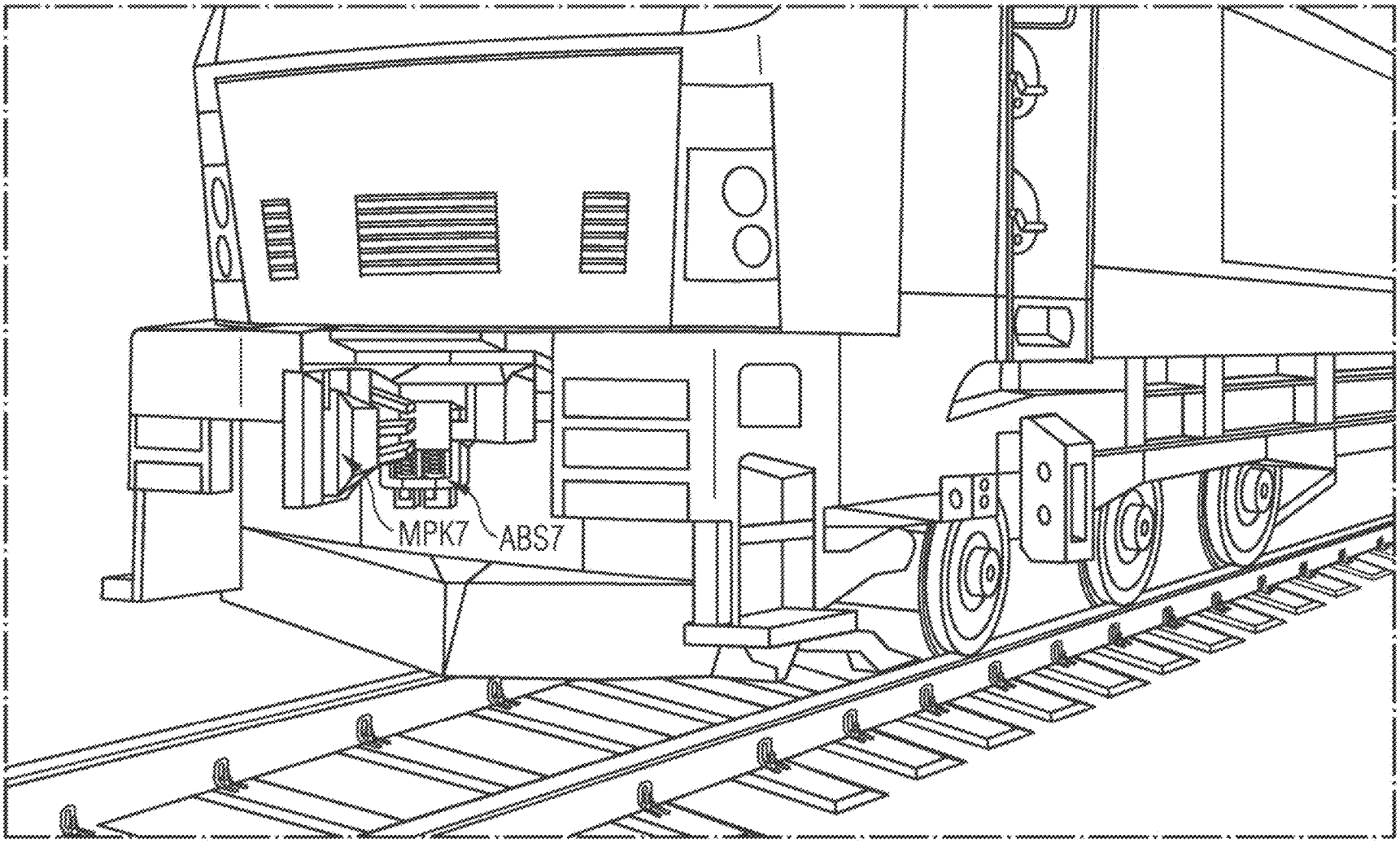
FIG 7 PRIOR ART
Figure 8:
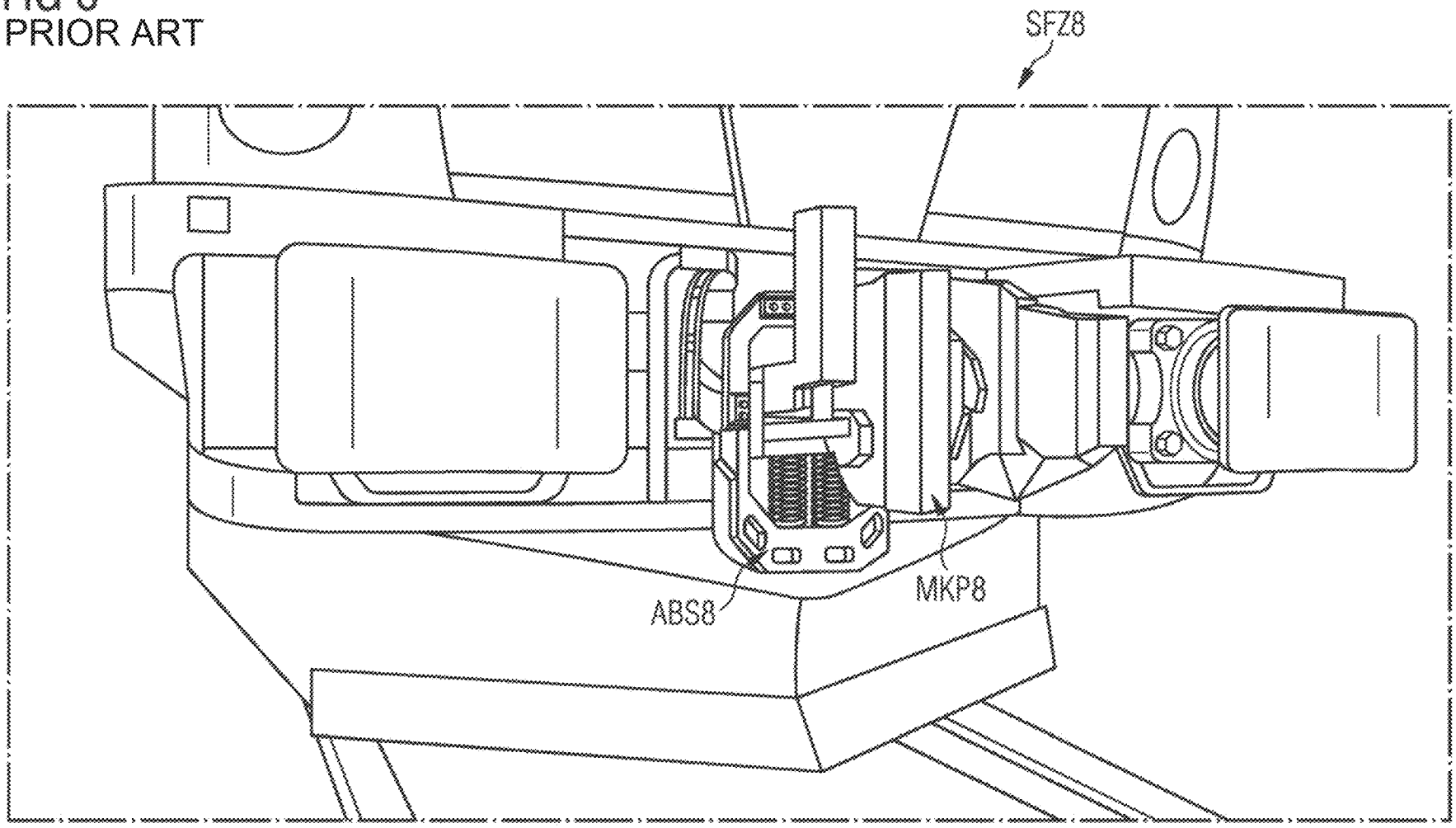
FIG 8 PRIOR ART

FIG. 4 shows a second example of the invention on the basis of a mixed train coupling GZK.

The mixed train coupling GZK comprises the above-described central buffer coupling MPK. Elements of a screw coupling, for example a coupling hook, are arranged on or in the region of the coupling head KPK.

In the operation of the screw coupling, side buffers SPF are additionally required for the event of a collision, which are embodied according to the prior art and comprise correspondingly shaped energy dissipation elements EVE-SPF.

Impact or thrust forces which occur during braking in the operative mode of the rail vehicle are absorbed or transmitted by the side buffers SPF of the rail vehicle.

In the event of a collision, the forces acting on the side buffers SPF exceed a predefined limit value, and irreversible deformation of the energy dissipation element EVE-SPF occurs in order to compensate for the collision energy or kinetic energy.

The invention claimed is:

1. A rail vehicle, comprising:

a carriage body;

a central buffer coupling having, as elements, a coupling head, a bar-shaped coupling shaft and a spring mechanism, wherein said coupling head is configured for connection to a further coupling head of a further rail vehicle, wherein said coupling head is connected to a first side of said bar-shaped coupling shaft and in which a second side of said bar-shaped coupling shaft dips into said spring mechanism and is mounted and fastened therein such that, in an operative mode of the rail vehicle, impact forces or tensile forces acting on said coupling head are elastically absorbed by said spring mechanism, said spring mechanism extending past said bar-shaped coupling and having an end connected to said carriage body of the rail vehicle, and the impact forces and the tensile forces are transmitted to said carriage body;

a support coupled to said bar-shaped coupling shaft and connected to said carriage body, said support configured to vertically support said bar-shaped coupling shaft in order to downwardly support said bar-shaped coupling shaft in a resilient manner in a vertical direction, said support further configured to bear a dead weight of said elements of said central buffer coupling in order to implement a horizontal orientation of said central buffer coupling in the operative mode of the rail vehicle; and a collision element disposed between said support and said carriage body and is connected both to said support and to said carriage body, said collision element having a deformation region configured such that kinetic energy, which is transmitted via said bar-shaped coupling shaft and via said support to said collision element in an event of a collision, non-reversibly deforms said deformation region in a predefined manner.

2. The rail vehicle according to claim 1, wherein:

said carriage body has a front plate;

said collision element has a first flange by way of which said collision element is firmly but releasably connected to said front plate of said carriage body by a screw connection;

said collision element has a second flange which lies opposite said first flange;

said deformation region is disposed between said first flange and said second flange;

said second flange is firmly but releasably connected to said support by a screw connection; and said screw connection of said second flange and said screw connection of said first flange are configured in such a way that an exchange of said collision element is possible after a collision.

3. The rail vehicle according to claim 1, wherein said collision element at least partially surrounds said bar-shaped coupling shaft so as to enable a horizontal movement of said bar-shaped coupling shaft to a predetermined extent.

4. The rail vehicle according to claim 1, wherein said support at least partially surrounds said bar-shaped coupling shaft so as to enable a horizontal movement of said bar-shaped coupling shaft to a predetermined extent.

5. The rail vehicle according to claim 4, wherein due to the at least partial surrounding of said bar-shaped coupling shaft by said support, a coupling of said support to said bar-shaped coupling shaft is implemented in such a way that, in the event of the collision, said bar-shaped coupling shaft executes a longitudinal movement in a direction of the rail vehicle or in a direction of said carriage body of the rail vehicle, and as a result said coupling head is pushed against said support and the kinetic energy from the collision is transmitted via said support to said collision element, in order to there trigger a deformation of said deformation region.

6. The rail vehicle according to claim 1, wherein said spring mechanism has energy dissipation elements which are configured in such a way that impact energy, which is transmitted via said bar-shaped coupling shaft to said spring mechanism in the event of the collision, irreversibly plastically deforms said energy dissipation elements for energy compensation purposes.

7. The rail vehicle according to claim 1, wherein said central buffer coupling is part of a mixed train coupling.

8. The rail vehicle according to claim 1, wherein said support is in a form of a pendulum support or in a form of a beam support, which are in each case at least partially disposed under said bar-shaped coupling shaft.

9. The rail vehicle according to claim 1, wherein said spring mechanism extends past said collision element in a direction of said carriage body of said rail vehicle.

* * * * *